US008952874B2

(12) United States Patent
Lee et al.

(10) Patent No.: US 8,952,874 B2
(45) Date of Patent: Feb. 10, 2015

(54) ORGANIC LIGHT EMITTING DISPLAY AND DRIVING METHOD THEREOF

(75) Inventors: Dukjin Lee, Yongin-si (KR); Jeongno Lee, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1777 days.

(21) Appl. No.: 12/078,745

(22) Filed: Apr. 4, 2008

(65) Prior Publication Data

US 2008/0246702 A1 Oct. 9, 2008

(30) Foreign Application Priority Data

Apr. 6, 2007 (KR) ..... 10-2007-0034288

(51) Int. Cl.
*G09G 3/32* (2006.01)

(52) U.S. Cl.
CPC ..... *G09G 3/3233* (2013.01); *G09G 2300/0842* (2013.01); *G09G 2320/041* (2013.01); *G09G 2330/02* (2013.01); *G09G 2330/021* (2013.01); *G09G 2330/028* (2013.01)
USPC ..... 345/82; 345/76; 345/77; 345/204

(58) Field of Classification Search
CPC ..... G09G 3/30; G09G 2320/041
USPC ..... 345/82, 76–77, 204
See application file for complete search history.

(56) References Cited

U.S. PATENT DOCUMENTS 6,137,280 A * 10/2000 Ackermann et al. ..... 323/354
7,154,494 B2 12/2006 Kato et al.
2005/0006557 A1* 1/2005 Zoller ..... 248/686
2005/0173615 A1* 8/2005 Hontele ..... 250/203.1
2005/0242747 A1 11/2005 Kato et al.
2007/0075940 A1* 4/2007 Nakamura ..... 345/77
2008/0055135 A1* 3/2008 Li et al. ..... 341/144
2010/0277141 A1* 11/2010 Sutardja ..... 323/234

FOREIGN PATENT DOCUMENTS

CN 1 691 115 A 11/2005
JP 07-227088 8/1995
JP 2005-208228 A 8/2005
JP 2005-316138 A 11/2005

(Continued)

OTHER PUBLICATIONS

Japanese Office Action in JP 2007-212901, dated Aug. 24, 2010 (Lee, et al.).

(Continued)

*Primary Examiner* — William Boddie
*Assistant Examiner* — Leonid Shapiro
(74) *Attorney, Agent, or Firm* — Lee & Morse, P.C.

(57) ABSTRACT

An organic light emitting display includes an organic light emitting display panel, a temperature detecting unit for detecting a temperature of the organic light emitting display panel, a driving voltage determining unit for outputting voltage data by calculating the driving voltage of the organic light emitting display panel on the basis of the temperature data detected by the temperature detecting unit, and a DC/DC converter having a variable resistor determining unit for setting a variable resistor on the basis of the voltage data output from the driving voltage determining unit, the DC/DC converter supplying the driving voltage corresponding to the variable resistor to the organic light emitting display panel.

17 Claims, 6 Drawing Sheets

(56) References Cited

FOREIGN PATENT DOCUMENTS

| | | | |
|---|---|---|---|
| JP | 2007-101951 | A | 4/2007 |
| KR | 10-2004-0078438 | A | 9/2004 |
| KR | 10 2005-0032416 | A | 4/2005 |
| KR | 10-2005-0032416 | A | 4/2005 |
| KR | 10-2005-0087476 | A | 8/2005 |
| KR | 10-0680913 | B1 | 2/2007 |

OTHER PUBLICATIONS

Japanese Notice of Allowance dated Sep. 18, 2012.

* cited by examiner

ORGANIC LIGHT EMITTING DISPLAY AND DRIVING METHOD THEREOF

BACKGROUND OF THE INVENTION

1. Field of the Invention

Embodiments relate to a display and a driving method thereof. More particularly, embodiments relate to a display and a driving method thereof in which a driving voltage is adjusted in accordance with temperature.

2. Description of the Related Art

A display may provide operating and driving voltages to a light emitting element, e.g., an organic light emitting diode (OLED), in order to emit light from the light emitting element. The driving voltages may provide power for emitting light from the light emitting element. The operating voltages may correspond to data signals and may control one or more driving transistors that regulate the connection of the driving voltages to the light emitting element.

Operational characteristics of the light emitting element, e.g., the amount of light emitted therefrom, may be temperature dependent. In order to maintain such operational characteristics constant, the driving voltage may be increased to offset the effects of reduced temperatures. However, maintaining an increased driving voltage when temperatures are not reduced may result in unnecessary power consumption.

SUMMARY OF THE INVENTION

Embodiments are therefore directed to a display and a driving method thereof which substantially overcome one or more of the problems due to limitations and disadvantages of the related art.

It is therefore a feature of embodiments to provide a display and a driving method thereof that adjust a driving voltage in accordance with temperature.

At least one of the above and other features and advantages of the present invention may be realized by providing an organic light emitting display, including an organic light emitting display panel, a temperature detecting unit for detecting a temperature of the organic light emitting display panel, a driving voltage determining unit for outputting voltage data by calculating the driving voltage of the organic light emitting display panel on the basis of the temperature data detected by the temperature detecting unit, and a DC/DC converter having a variable resistor determining unit for setting a variable resistor on the basis of the voltage data output from the driving voltage determining unit, the DC/DC converter supplying the driving voltage corresponding to the variable resistor to the organic light emitting display panel.

The temperature detecting unit may include a temperature sensor for detecting the temperature of the organic light emitting display panel, and an A/D converter for converting an output of the temperature sensor into a digital signal. The driving voltage determining unit may include a driving voltage control unit for calculating the driving voltage in accordance with the temperature data, and a driving voltage output unit for outputting voltage data calculated by the driving voltage control unit. The driving voltage control unit may include a look-up table in which voltage data calculated in accordance with the temperature data is stored.

The variable resistor determining unit may include a variable resistor circuit unit having a plurality of resistors and a plurality of resistor control switching transistors which are electrically connected to the resistors, respectively. The variable resistor determining unit may include a variable resistor control unit for selecting the resistors by controlling the resistor control switching transistors. The variable resistor control unit may include a look-up table in which variable resistor data corresponding to the voltage data is stored.

The DC/DC converter may further include a boost converter for supplying a first voltage to the organic light emitting display panel, and an inverter for supplying a second voltage to the organic light emitting display panel. The DC/DC converter may further include a switching control unit electrically connected to the boost converter and the inverter. The DC/DC converter may include a first resistor and a second resistor. The first and second resistors may be serially connected to an output terminal of the boost converter, and a node to which the first and second resistors are each connected may be electrically connected with the switching control unit. The switching control unit may include a first comparator electrically connected to the node where the first and second resistors are connected.

The DC/DC converter may include a third resistor having one terminal electrically connected to the variable resistor circuit unit and having another terminal electrically connected to an output terminal of the inverter. Each resistor control switching transistor may include a first electrode electrically connected to a respective resistor of the variable resistor circuit unit, and a second electrode electrically connected to the third resistor. The switching control unit may include a second comparator electrically connected to a node to which the resistors of the variable resistor circuit unit and the third resistor are connected. A voltage level of the second voltage may be determined by the resistors of the variable resistor circuit unit. A voltage level of the second voltage may be lower than that of the first voltage.

At least one of the above and other features and advantages of the present invention may also be realized by providing a driving method of an organic light emitting display, including detecting a temperature of an organic light emitting display panel, determining a driving voltage according to temperature data generated from detecting the temperature, setting a variable resistor included in a DC/DC converter according to voltage data generated from determining the driving voltage, and supplying the driving voltage corresponding to the variable resistor setting to the organic light emitting display panel.

Detecting the temperature may include an A/D conversion for converting an output of a temperature sensor into a digital signal after detecting the temperature of the organic light emitting display panel using the temperature sensor. Determining the driving voltage may include calculating the driving voltage according to the temperature data generated detecting the temperature, and outputting the driving voltage based on the calculation. Determining the driving voltage may use a look-up table in which voltage data calculated in accordance with temperature data is stored.

Setting the variable resistor may include calculating a variable resistance in a variable resistor control unit included in the DC/DC converter. Calculating the variable resistance may use a look-up table in which variable resistor data corresponding to voltage data is stored. Setting the variable resistor may include selecting resistors from among a plurality of resistors that are electrically connected to respective resistor control switching transistors by selectively turning on the resistor control switching transistors using the variable resistor control unit according to the variable resistor data.

Supplying the driving voltage may supply a first voltage to the organic light emitting display panel through a boost converter included in the DC/DC converter, and may supply a second voltage to the organic light emitting display panel through an inverter included in the DC/DC converter. The DC/DC converter may include a fixed resistor having one terminal electrically connected to an output terminal of the inverter and having another terminal electrically connected to the plurality of resistors, and the voltage level of the second voltage may be determined by the plurality of resistors and the fixed resistor. The voltage level of the second voltage may be lower than that of the first voltage.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION OF THE INVENTION

Figure 1:
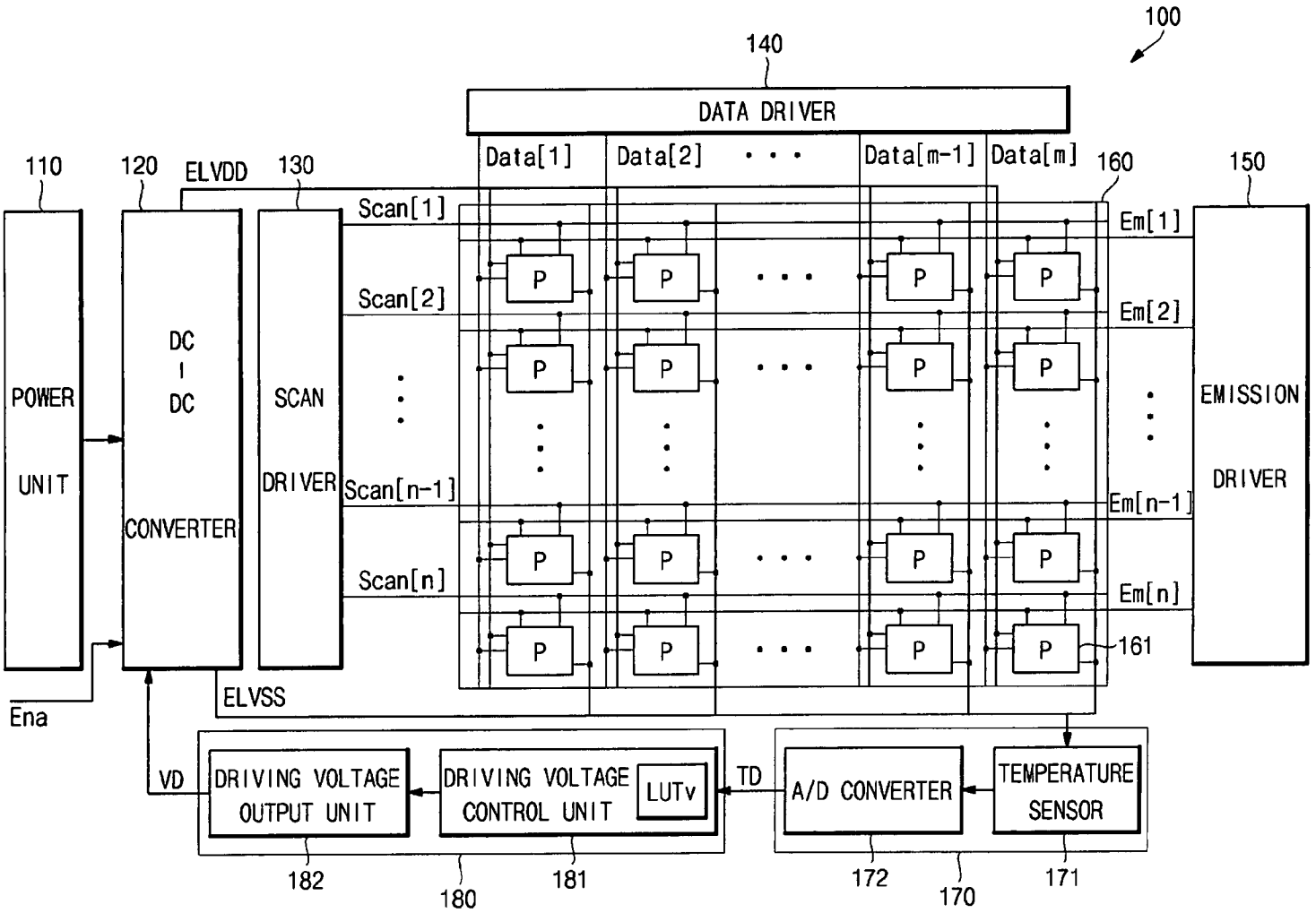
FIG. 1 illustrates a block diagram of a display according to an example embodiment.

Korean Patent Application No. 10-2007-0034288, filed on Apr. 6, 2007, and entitled: "Organic Light Emitting Display and Driving Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Similarly, where an element is described as being coupled to a second element, the element may be directly coupled to second element, or may be indirectly coupled to second element via one or more other elements. Further, where an element is described as being coupled to a second element, it will be understood that the elements may be electrically coupled, e.g., in the case of transistors, capacitors, power sources, nodes, etc. Where two or more elements are described as being coupled to a node, the elements may be directly coupled to the node, or may be coupled via conductive features to which the node is common. Thus, where embodiments are described or illustrated as having two or more elements that are coupled at a common point, it will be appreciated that the elements may be coupled at respective points on a conductive feature that extends between the respective points. Like reference numerals refer to like elements throughout.

Referring to FIG. 1, a display 100 according to an example embodiment may include a power unit 110, a DC/DC converter 120, a scan driver 130, a data driver 140, an emission driver 150, a display panel 160 such as an organic light emitting display panel, a temperature detecting unit 170, and a driving voltage determining unit 180. The display panel 160 may include one or more light emitting elements, e.g., OLEDs. The DC/DC converter 120 may include a variable resistance determining unit 126 (described in detail below in connection with FIG. 4) that changes resistance in accordance with voltage data output from the driving voltage determining unit 180. An enable terminal Ena may be provided in the DC/DC converter 120. The DC/DC converter 120 may be activated or inactivated depending on whether an enable signal or disable signal, respectively, is input through the enable terminal Ena.

The power unit 110 may be, e.g., a battery supplying direct current power, or a rectifier converting alternating current power into direct current power, etc. The DC/DC converter 120 may be coupled between the power unit 110 and the display panel 160. The DC/DC converter 120 may convert power from the power unit 110 into a first voltage ELVDD and a second voltage ELVSS, and may supply the first and second voltages ELVDD, ELVSS to the display 100. In an implementation, the first voltage ELVDD may be a positive voltage and the second voltage ELVSS may be a negative voltage.

The resistance of the variable resistance determining unit 126 may be changed in accordance with voltage data VD output from the driving voltage determining unit 180, as will be described in more detail below. The DC/DC converter 120 may control the voltage level of the second voltage ELVSS according to the resistor(s) selected by the variable resistance determining unit 126.

Voltage data VD output from the driving voltage determining unit 180 may be changed in accordance with temperature data TD output from the temperature detecting unit 170, as will be described in more detail below. The DC/DC converter 120 may control the output voltage, e.g., the second voltage ELVSS, by changing a variable resistance in accordance with the temperature of the display panel 160 and/or the surrounding, i.e., ambient, temperature.

The scan driver 130 may be coupled to the display panel 160. The scan driver 130 may be coupled to the display panel 160 via a plurality of scan lines Scan[1] to Scan[n]. The scan driver 130 may supply scan signals to the display panel 160 via the scan lines Scan[1] to Scan[n] in sequence.

The data driver 140 may be coupled to the display panel 160. The data driver 140 may be coupled to the display panel 160 via a plurality of data lines Data[1] to Data[m]. The data driver 140 may supply data signals to the display panel 160 via the data lines Data[1] to Data[m].

The emission driver 150 may be coupled to the display panel 160 via a plurality of emission lines Em[1] to Em[n]. The emission driver 150 may supply emission signals to the display panel 160 via the emission lines Em[1] to Em[n] in sequence.

The scan driver 130, the data driver 140, the emission driver 150, and the display panel 160 may be formed on one substrate, e.g., as one or more integrated circuits. The drivers 130, 140, and 150 may be formed in the same layer in which the scan lines Scan[1] to Scan[n], the data lines Data[1] to Data[m], the emission lines Em[1] to Em[n], and the transistors of the pixel circuit 161 are formed. In another implementation, the drivers 130, 140, and 150 may be formed separately and coupled via conductive members to corresponding portions of the display 100. The drivers 130, 140, and 150 may be implemented as, e.g., flexible printed circuits (FPCs), tape carrier packages (TCPs), tape automatic bonding (TAB) arrangements, chip on glass (COG) arrangements, etc.

The display panel 160 may include pixel circuits 161. The pixel circuits 161 may be coupled to respective scan lines Scan[1] to Scan[n] and emission lines Em[1] to Em[n]. The scan lines Scan[1] to Scan[n] and the emission lines Em[1] to Em[n] may be arranged in a row direction. The pixel circuits 161 may also be coupled to respective data lines Data[1] to Data[m]. The data lines Data[1] to Data[m] may be arranged in a column direction. Each pixel circuit 161 may be formed where corresponding ones of the scan lines Scan[1] to Scan [n] and the data lines Data[1] to Data[m] cross.

Figure 2:
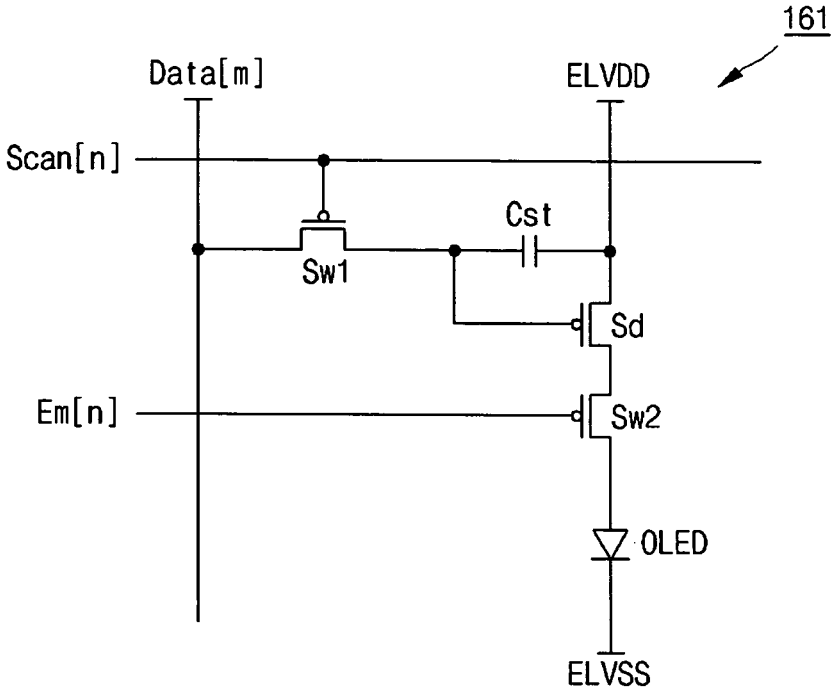
FIG. 2 illustrates a schematic diagram of a pixel circuit according to an example embodiment.

FIG. 2 illustrates a schematic diagram of a pixel circuit according to an example embodiment. Referring to FIG. 2, each pixel circuit 161 may include an OLED, a driving transistor Sd for supplying a driving current to the OLED, a storage capacitor Cst, a first switching transistor Sw1 and a second switching transistor Sw2. The OLED may include an anode which may be coupled to the driving transistor Sd, e.g., via the second switching transistor Sw2, and a cathode which may be coupled to the second voltage ELVSS. The OLED may generate light, e.g., red (R) color, green (G) color, or blue (B) color light, the luminance of which may be controlled in accordance with the driving current supplied from the driving transistor Sd.

The driving transistor Sd may include a first electrode (source or drain) coupled to the first voltage ELVDD, a second electrode (source or drain) coupled to the anode of the OLED, e.g., via the second switching transistor Sw2, and a control electrode (gate electrode), which may be activated in accordance with a data signal supplied from a data line Data [j] (where j is from 1 to m, inclusive). The driving transistor Sd may transfer the driving current, corresponding to the data signal supplied from the data line Data[j], to the OLED.

The storage capacitor Cst may have a first electrode coupled to the control electrode of the driving transistor Sd, and a second electrode coupled to the first voltage ELVDD and the first electrode (source or drain) of the driving transistor Sd. The storage capacitor Cst may store a voltage between the first electrode (source or drain) and the control electrode (or gate electrode) of the driving transistor Sd, and may store a charge used to control the driving transistor Sd for emission of light by the OLED.

The first switching transistor Sw1 may include a first electrode (source or drain) coupled to the data line DataL[j], a second electrode (source or drain) coupled to the driving transistor Sd, and a control electrode (gate electrode) coupled to a scan line Scan[i] (where i is from 1 to n, inclusive). The first switching transistor Sw1 may supply the data signal from the data line Data[j] to the storage capacitor Cst.

The second switching transistor Sw2 may include a first electrode (source or drain) coupled to the second electrode (drain or source) of the driving transistor Sd, and a second electrode (drain or source) coupled to the anode of the OLED. The control electrode of the second switching transistor Sw2 may be coupled to an emission line Em[i] (where i is from 1 to n, inclusive). The second switching transistor Sw2 may control the emission time of the display panel 160 by controlling the driving current flowing from the driving transistor Sd to the display panel 160 in accordance with the emission signal supplied through the emission line En[i].

The display panel 160 may be driven by the first voltage ELVDD and the second voltage ELVSS supplied from the DC/DC converter 120. The driving voltage, i.e., the difference between the first voltage ELVDD and the second voltage ELVSS, supplied to the display panel 160 may be set in accordance with the temperature data TD provided by the temperature detecting unit 170. The driving voltage may be set to have different driving voltage margins in accordance with the temperature data TD.

The temperature detecting unit 170 may include a temperature sensor 171 and an A/D converter 172. The temperature sensor 171 may be formed inside or outside of the display panel 160. The temperature sensor 171 may detect the temperature of the display panel 160 and/or the surroundings thereof. The temperature sensor 171 may generate the temperature data TD and may transfer it to the driving voltage determining unit 180.

The A/D converter 172 may be provided for converting an analog signal into a digital signal when the temperature data TD output by the temperature sensor 171 is an analog signal. Digitized temperature data TD produced by the A/D converter 172 may be transferred to the driving voltage determining unit 180.

The driving voltage determining unit 180 may include a driving voltage control unit 181 and a driving voltage output unit 182. The driving voltage control unit 181 may calculate a driving voltage in accordance with the temperature data TD output from the temperature detecting unit 170 and may control the driving voltage output unit 182 accordingly. The driving voltage control unit 181 may include a look-up table LUTv in which values of the voltage data VD corresponding to values of the temperature data TD may be stored.

Figure 3:
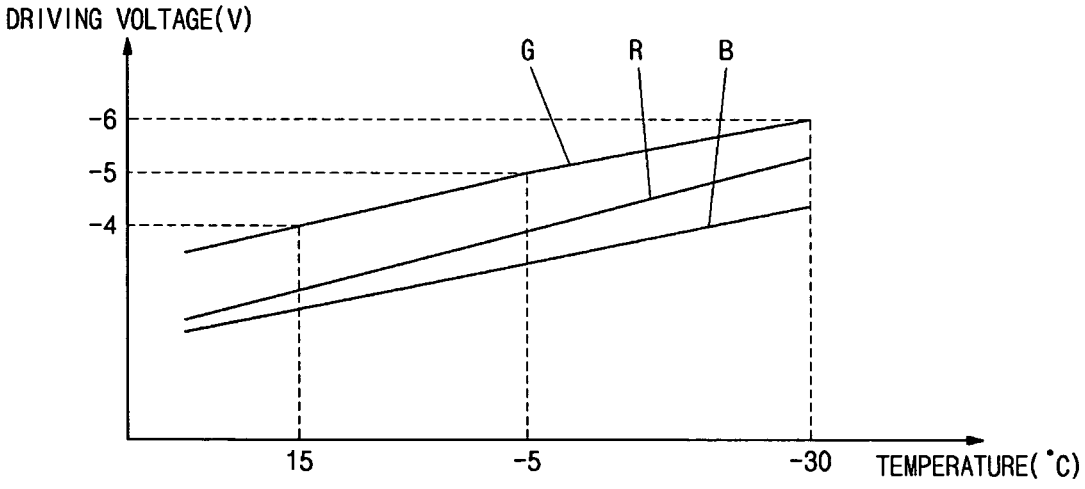
FIG. 3 illustrates a voltage characteristic of an OLED varying in accordance with temperature.

FIG. 3 illustrates a voltage characteristic of an OLED in accordance with temperature. Referring to FIG. 3, in an implementation, the driving voltage may have higher voltage levels as the temperature is reduced, i.e., the driving voltage may be increased according to the reduced temperature.

The voltage data VD stored in the driving voltage look-up table LUTv may be determined on the basis of the voltage characteristics of the OLEDs. For example, the driving voltage may be different depending on the color of light emitted by the OLED. Referring to FIG. 3, in an implementation, the driving voltage of the OLED may increase in accordance with the emission color, in the order of blue (B), red (R), and green (G). The green (G) color may require the highest driving voltage and may be set as a standard.

The driving voltage look-up table LUTv may store values of the temperature data TD and corresponding values of the voltage data VD, e.g., as in Table 1 below. In Table 1, TD1 to TD3 represent values of the temperature data TD output from the temperature detecting unit 170. TD1 may represent a temperature of 15° C., TD2 may represent a temperature of −5° C., and TD3 may represent a temperature of −30° C. VD may represent the voltage data VD corresponding to the respective temperature data TD1 to TD3. The units for the voltage data VD may be, e.g., volts (V).

TABLE 1

| | TD1 | TD2 | TD3 |
|---|---|---|---|
| VD | −4 | −5 | −6 |

It is noted that the values in Table 1 are merely examples, which correspond to the graph in FIG. 3. The driving voltage look-up table LUTv may include more or less than three temperature values. Further, the driving voltage look-up table LUTv may be implemented in ways other than in Table 1, e.g., the driving voltage look-up table LUTv may be implemented as a numerical formula corresponding to a graph such as that illustrated in FIG. 3, etc. In another implementation (not shown), the temperature values may be used to look up resistance values directly, as described below.

Figure 4:
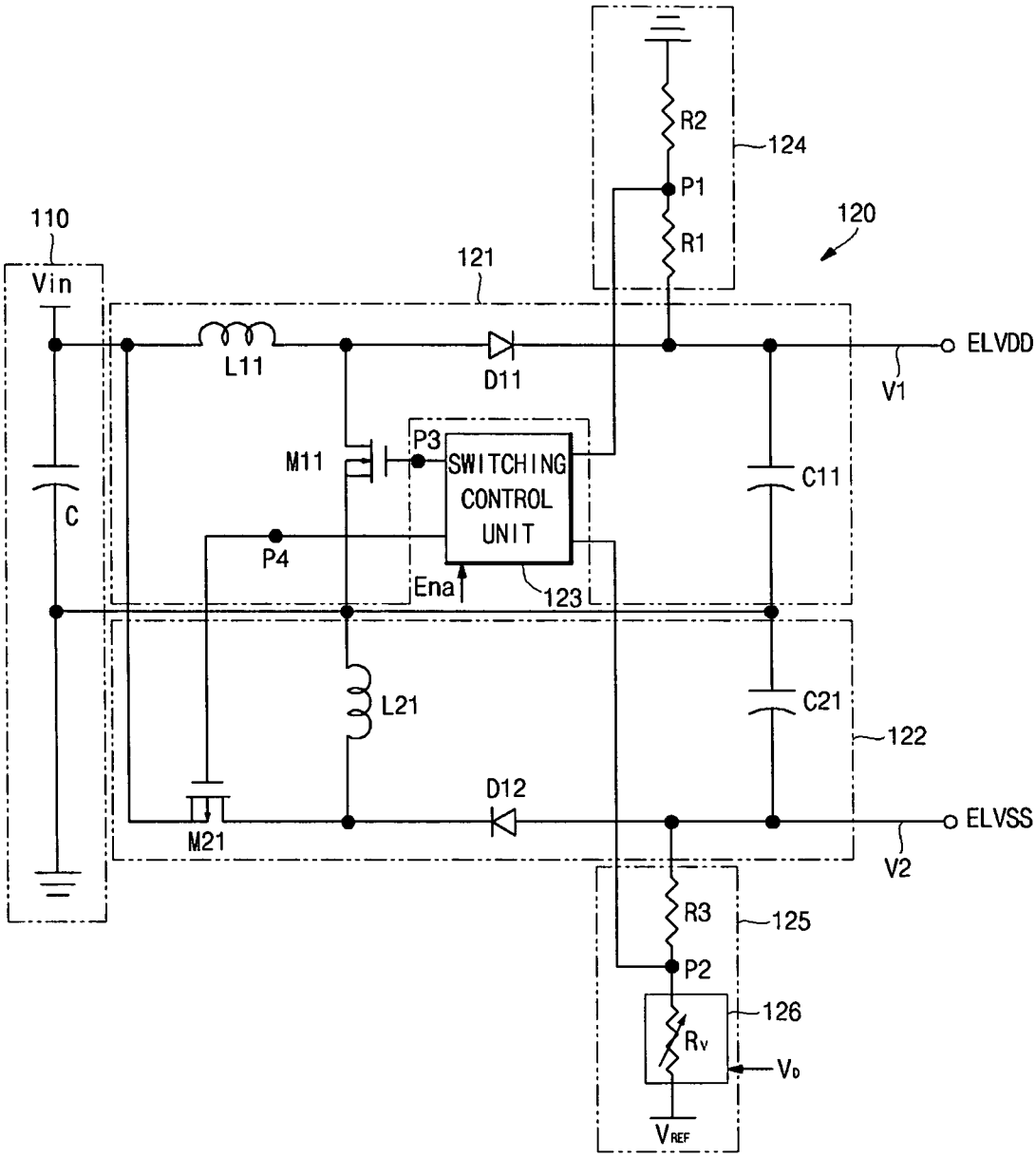
FIG. 4 illustrates a schematic diagram of a DC/DC converter according to an example embodiment.

FIG. 4 illustrates a schematic diagram of the DC/DC converter 120 according to an example embodiment. The driving voltage output unit 182 of the driving voltage determining unit 180 may output the voltage data VD received from the driving voltage control unit 181 to the DC/DC converter 120. The DC/DC converter 120 may control the voltage supplied to the display panel 160 according to the voltage data VD.

Referring to FIG. 4, the DC/DC converter 120 may operate as a switched mode power supply, and may include a boost converter 121, an inverter 122, a switching control unit 123, a first feedback voltage divider 124, and a second feedback voltage divider 125. The switching control unit 123 may be coupled to the boost converter 121 and the inverter 122. The second feedback voltage divider 125 may include a variable resistance determining unit 126 for changing the second voltage ELVSS. The DC/DC converter 120 may supply the first voltage ELVDD to the display panel 160 over a first voltage line V1, and may supply the second voltage ELVSS to the display panel 160 over a second voltage line V2.

The boost converter 121 may include a first switching transistor M11 coupled to the power unit 110 via a first inductive element L11, and a first diode D11 coupled between the first switching transistor M11 and the first voltage line V1. The first switching transistor M11 may be coupled to a node that is common to the first inductive element L11 and the first diode D11. The boost converter 121 may further include a first storage capacitor C11 coupled to a node that is common to the first diode D11 and the first voltage line V1.

The boost converter 121 may be coupled to the first feedback voltage divider 124, which may be used to control the first voltage ELVDD output on the first voltage line V1 within a specific level. The first feedback voltage divider 124 may include a first resistor R1 and a second resistor R2 serially connected to an output terminal. The output terminal may be connected to a node that is common to the first voltage line V1 and the first diode D11. A first point P1 that is common to the first and second resistors R1, R2 may be coupled to the switching control unit 123, as described in more detail below.

The inverter 122 may include a second switching transistor M21 coupled to the power unit 110, and a second diode D12 coupled between the second switching transistor M21 and the second voltage line V2. A second inductive element L21 may be coupled to a node that is common to the second switching transistor M21 and the second diode D21. A second storage capacitor C21 may be coupled to a node that is common to the second diode D21 and the second voltage line V2.

The inverter 122 may be coupled to the second feedback voltage divider 125, which may be used to control the second voltage ELVSS output on the second voltage line V2 within a specific level. The second voltage ELVSS output on the second voltage line V2 may be changed in accordance with resistor data selected from the variable resistance determining unit 126 in the second feedback voltage divider 125.

The second feedback voltage divider 125 may include a third resistor R3 and a variable resistance element Rv serially connected to an output terminal. The output terminal may be connected to a node that is common to the second diode D21 and the second voltage line V2. A second point P2 that is common to the third resistor R3 and the variable resistance element Rv may be coupled to the switching control unit 123, as described in more detail below.

Figure 5:
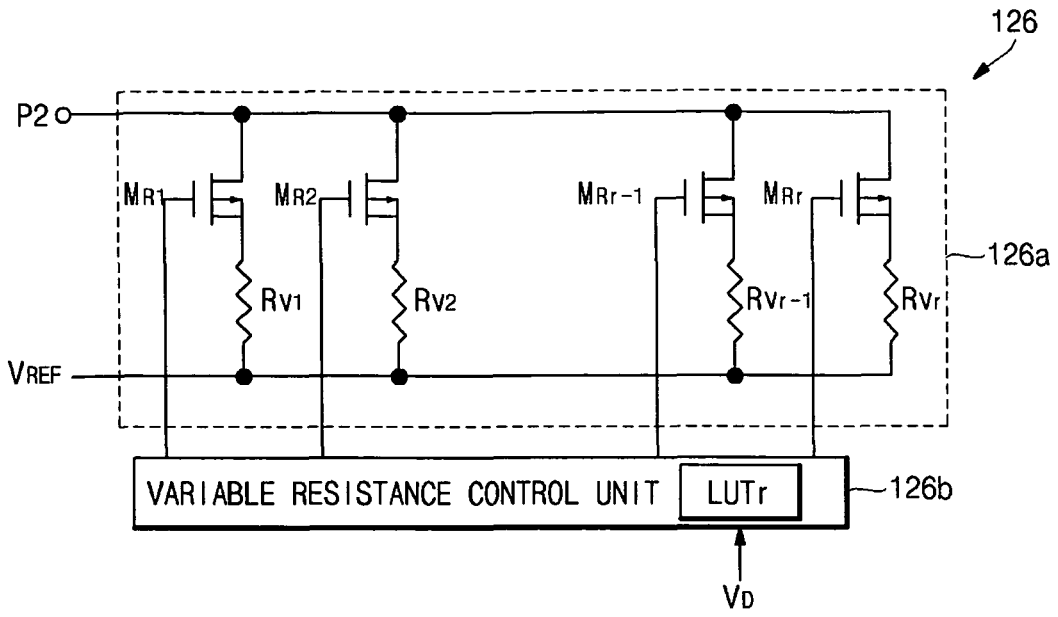
FIG. 5 illustrates a schematic diagram of a variable resistance determining unit in the DC/DC converter of FIG. 4.

FIG. 5 illustrates a schematic diagram of the variable resistance determining unit 126 in the DC/DC converter of FIG. 4. Referring to FIG. 5, the resistance of the variable resistance element Rv in the second feedback voltage divider 125 may correspond to that of one or more resistors Rv1 to Rvr, which may be connected in parallel, which are selected by the variable resistance determining unit 126.

The variable resistance determining unit 126 may include a variable resistance circuit unit 126*a* and a variable resistance control unit 126*b*. The variable resistance control unit 126*b* may include a variable resistance look-up table LUTr in which resistance data RD corresponding to values of the voltage data VD are stored.

The variable resistance control unit 126*a* may include the resistors Rv1 to Rvr, as a well as respective resistor control switching transistors MR1 to MRr coupled to and controlling the resistors Rv1 to Rvr. The resistors Rv1 to Rvr may have different resistance values. The number of resistors Rv1 to Rvr may correspond to the number of values of the resistance data RD provided by the variable resistance control unit 126*b*, although the number of resistors may be different in other implementations.

Each of the resistor control switching transistors MR1 to MRr may have a first electrode coupled to a respective one of the resistors Rv1 to Rvr, and a second electrode may be coupled to the third resistor R3 of the inverter 122 via the second point P2. Control electrodes of the resistor control switching transistors MR1 to MRr may be coupled to respective outputs of the variable resistance control unit 126*b*. The resistor control switching transistors MR1 to MRr may be turned on or off according to control signals transmitted from the variable resistance control unit 126*b*.

The variable resistance control unit 126*b* may select at least one resistor from the plurality of resistors Rv1 to Rvr. For example, the first resistor control switching transistor MR1 may be turned on to couple the first resistor Rv1 to the third resistor R3, and thus control the second voltage ELVSS output by the inverter 122. In an implementation, the resistor control switching transistors MR1 to MRr may be n-type MOSFETs. In another implementation, the resistor control switching transistors MR1 to MRr may be p-type MOSFETs or other elements suitable for controlling the resistors Rv1 to Rvr.

The variable resistance control unit 126*b* may select at least one of the plurality of resistors Rv1 to Rvr of the variable resistance circuit unit 126*a* according to the voltage data VD. The variable resistance control unit 126*b* may include the variable resistance look-up table LUTr in which resistance data RD corresponding to values of the voltage data VD may be stored. The value of the voltage data VD output from the driving voltage determining unit 180 may be used for indexing into the variable resistance look-up table LUTr to obtain the corresponding value of the resistance data RD.

The resistance data RD stored in the variable resistance look-up table LUTr may be determined with reference to Formula 1 and Formula 2. Formula 1 represents the voltage divided by the third resistor R3 and the variable resistance element Rv of the second feedback voltage divider 125. Formula 2 represents the voltage that may be output by the inverter 122, i.e., the second voltage ELVSS. In an implementation, ELVSS may be, e.g., 4.6 V, and ELVDD may be, e.g., −5.4 V.

$$\frac{R3}{Rv} = \frac{(V_{FBI} - V_{OUT})}{(V_{REF} - V_{FBI})} \quad \text{(Formula 1)}$$

$$V_{OUT} = -1.25 \times \frac{R3}{Rv} \quad \text{(Formula 2)}$$

In Formula 1, $V_{REF}$ may be a reference voltage supplied from the switching control unit 123, and $V_{OUT}$ may be the output voltage of the inverter 122. The voltage $V_{FB1}$ may correspond to a feedback voltage, used to determine the desired output voltage between $V_{REF}$ and $V_{OUT}$, at the second point P2 between the third resistor R3 and the variable resistance element Rv.

In an implementation, the reference voltage $V_{REF}$ of the inverter 122 may be supplied from the DC/DC converter 120 and may be set to have a voltage level of, e.g., about −1.25 V. The feedback voltage $V_{FB1}$ may be set to have a voltage level of, e.g., about 0 V. Therefore, the output voltage $V_{OUT}$ of the inverter 122 may be described by Formula 2.

The variable resistance look-up table LUTr may store values of the voltage data VD and corresponding values of the resistance data RD, as shown by the examples in Table 2 below. In Table 2, VD1 to VD3 may be the voltage data output from the driving voltage determining unit 180. VD1 may represent −4 V, VD2 may represent −5 V and VD3 may represent −6 V. RD represents the resistance data RD according to the respective voltage data VD1 to VD3, and may be in units of kΩ. The example values in Table 2 correspond to a resistance of the third resistor R3 of 200 kΩ.

TABLE 2

| | VD1 | VD2 | VD3 |
|---|---|---|---|
| RD | 63 | 50 | 42 |

Referring to FIG. 5, the variable resistance control unit 126*b* may transmit control signals for turning on the resistor control switching transistors MR1 to MRr, which are coupled to corresponding resistors Rv1 to Rvr. Various subsets of the resistors Rv1 to Rvr may be coupled between $V_{REF}$ and P2 by activating one or more of the resistor control switching transistors MR1 to MRr thereby determining the resistance of the variable resistance element Rv.

Based on the variable resistance element Rv, the DC/DC converter 120 may provide the second voltage ELVSS, i.e., the voltage output on the second power line V2, to the display panel 160. In particular, the DC/DC converter 120 may transfer the feedback voltage $V_{FB1}$, which may be provided as a voltage output from the voltage divider formed by the third resistor R3 and the variable resistance element Rv, to the switching control unit 123.

Figure 6:
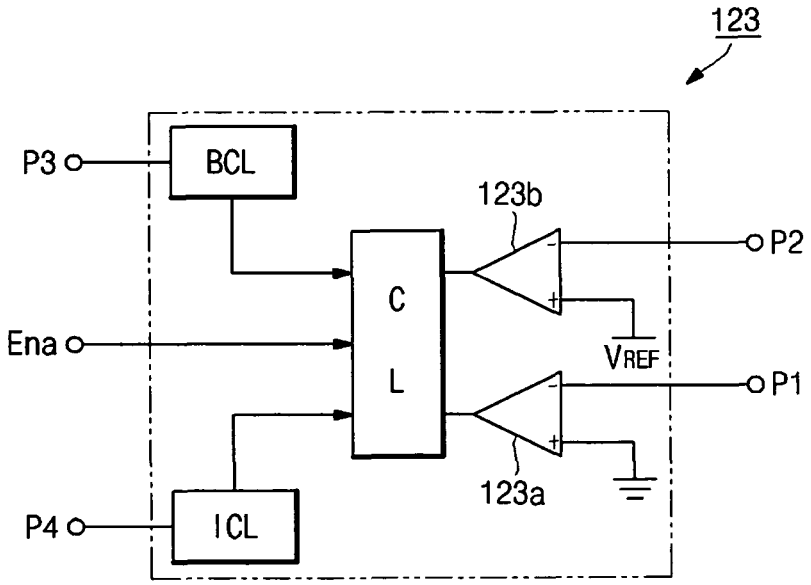
FIG. 6 illustrates a block diagram of a switching control unit in the DC/DC converter of FIG. 4.

FIG. 6 illustrates a block diagram of a switching control unit in the DC/DC converter of FIG. 4. Referring to FIG. 6, the switching control unit 123 may include a first comparator 123*a*, a second comparator 123*b*, a control logic unit CL, a booster control logic unit BCL, and an inverter control logic unit ICL.

The first comparator 123*a* may be coupled to the contact point P1 that is common to the first resistor R1 and the second resistor R2 of the boost converter 121. The voltage of the first contact point P1 may be input to the first comparator 123*a*, and the first comparator 123*a* may output a control signal for maintaining the first voltage ELVDD to the control logic unit CL. The control logic unit CL may be coupled to the booster control logic unit BCL, and may control the first switching transistor M11. The booster control logic unit BCL may be coupled to the control electrode of the first switching transistor M11, i.e., the booster control logic unit BCL may be coupled to the third contact point P3. The level of the first voltage ELVDD may be controlled by changing the switching frequency of the first switching transistor M11.

The second comparator 123*b* may be coupled to the second contact point P2, i.e., at a point common to the third resistor R3 and the variable resistance element Rv. The voltage at the second contact point P2 may be input to the second comparator 123*b* so that the second comparator 123*b* may output a control signal for maintaining the second voltage ELVSS to the control logic unit CL. The control logic unit CL may be coupled to the inverter control logic unit ICL, and may control the second switching transistor M21. The inverter control logic unit ICL may be coupled to the control electrode of the second switching transistor M21, i.e., the inverter control logic unit ICL may be coupled to the fourth contact point P4.

Referring to FIGS. 4 and 6, the switching control unit 123 may compare the feedback voltage provided by the voltage divider of the second feedback voltage divider 126 with the reference voltage $V_{REF}$, and may supply a control signal to the second switching transistor M21 based on the comparison. The DC/DC converter 120 may control the second switching transistor M21 so as to control the level of the second voltage ELVSS supplied to the second power line V2. In an implementation, the DC/DC converter 120 may control a switching frequency of the second switching transistor M21. The resistance of the variable resistance element Rv coupled to the second comparator 123*b* may be changed in accordance with the temperature. Thus, the inverter 122 may control the second voltage ELVSS in accordance with the variable resistance element Rv.

The control logic unit CL may be coupled to the enable terminal Ena, to which an external enable/disable signal may be provided. When an enable signal is input to the enable terminal Ena, the first and second switching transistors M11, M21 may be activated, respectively. The control logic unit CL may output the appropriate control signals to command operation of the booster control logic unit BCL and the inverter control logic unit ICL. When a disable signal is input to the enable terminal Ena, the first and second switching transistors M11, M21 may be turned off. The control logic unit CL may output the appropriate control signals to stop operation of the booster control logic unit BCL and the inverter control logic unit ICL, which may prevent power from being supplied to the display panel 160.

Figure 7:
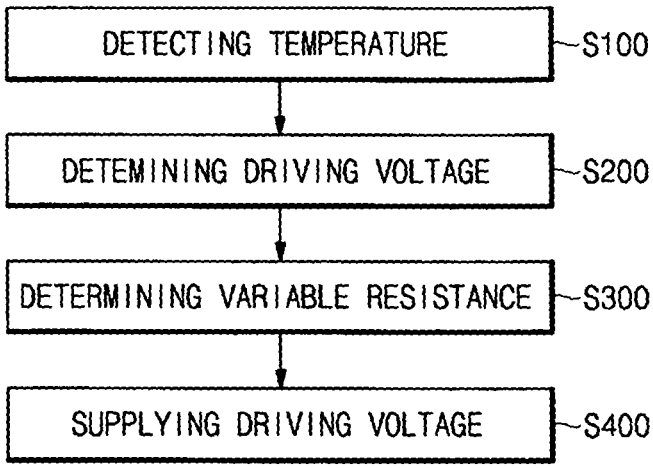
FIG. 7 illustrates a flow chart of a driving method for driving a display according to an example embodiment.
Figure 8:
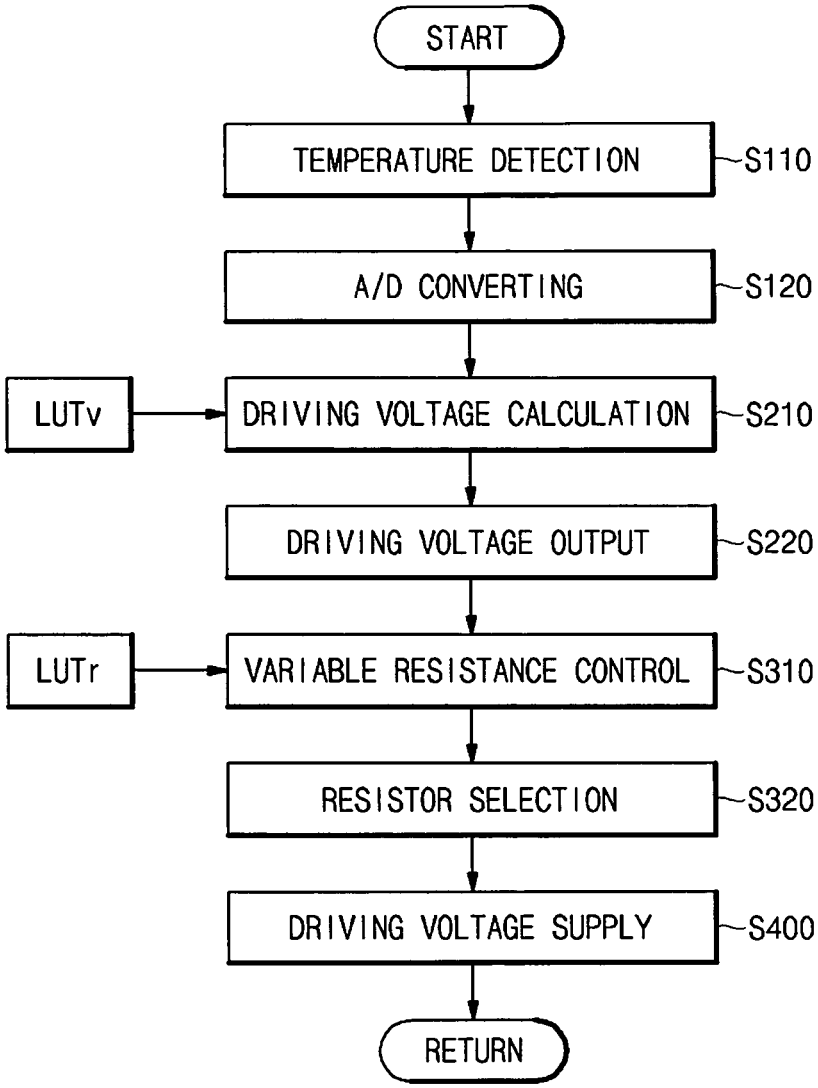
FIG. 8 illustrates details of the driving method of FIG. 7.

FIG. 7 illustrates a flow chart of a driving method for driving a display according to an example embodiment, and FIG. 8 illustrates details of the driving method of FIG. 7. Referring to FIGS. 7 and 8, the method may include a temperature detecting operation S100, a driving voltage determining operation S200, a variable resistance determining operation S300, and a driving voltage supplying operation S400.

The operation of detecting temperature S100 may include operations of detecting temperature S10 and analog-to-digital (A/D) conversion of the detected temperature S120. The operation of detecting temperature S110 may include detecting the temperature of the display panel 160 and/or an ambient temperature. For an analog temperature signal, the operation of A/D conversion S120 may convert the signal into a digital signal using the A/D converter 172, and may transfer the digital signal to the driving voltage determining unit 180.

The operation of determining the driving voltage S200 may include an operation of calculating the driving voltage S210 and an operation of outputting the driving voltage S220. The operation of calculating the driving voltage S210 may be performed in the driving voltage control unit 181. The operation of calculating the driving voltage S210 may determine the voltage data VD to be output on the basis of the temperature data TD input from the driving voltage control unit 181. The voltage data VD may be stored in the driving voltage look-up table LUTv included in the driving voltage control unit 181. The driving voltage look-up table LUTv may store voltage data VD having values as shown, for example, in Table 1.

The operation of outputting the driving voltage S220 may output the value calculated from the driving voltage control unit 181 or the value corresponding to the driving voltage look-up table LUTv. The output voltage data VD may be transferred to the variable resistance determining unit 126 of the DC/DC converter 120.

The operation of determining variable resistance S300 may include an operation of calculating the variable resistance S310 and an operation of selecting the variable resistance S320. The operation of calculating the variable resistance S310 may be performed in the variable resistance control unit 126*b* of the variable resistance determining unit 126. The operation of calculating the variable resistance S310 may calculate the resistance data RD corresponding to the received voltage data VD.

The variable resistance control unit 126*b* may include the variable resistance look-up table LUTr in which the resistance data RD is stored. For example, the variable resistance look-up table LUTr may store the resistance data RD as shown in Table 2. The variable resistance control unit 126*b* may turn on and off the resistor control switching transistors MR1 to MRr, which select corresponding resistors Rv1 to Rvr, in accordance with the resistance data RD.

The operation of selecting the variable resistance S320 may be performed in the variable resistance circuit unit 126*a*. The operation of selecting the variable resistance S320 may select the desired resistance of the variable resistance element Rv by controlling the connections of the resistors Rv1 to Rvr, which may be connected in parallel. In an implementation, in the voltage divider that includes the third resistor R3 and the variable resistance element Rv, at least one resistor switching transistor MR1 to MRr may be turned on in accordance with the control signal supplied from the variable resistance control unit 126*b*.

The operation of supplying the driving voltage S400 may supply the first voltage ELVDD and the second voltage ELVSS to the display panel 160. In particular, the DC/DC converter 120 may transfer a feedback voltage, altered in accordance with the third resistor R3 and the variable resistance element Rv, to the switching control unit 123. The switching control unit 123 may supply a control signal to the switching transistor M21 after comparing the feedback voltage with the reference voltage. Therefore, the DC/DC converter 120 may control the level of the second voltage ELVSS supplied to the second power line V2 in accordance with the switching frequency of the second switching transistor M21.

The first voltage ELVDD may be the output voltage of the boost converter 121. Referring again to FIG. 2, the first voltage ELVDD may be supplied to the first electrode (source or drain) of the driving transistor Sd. The first voltage ELVDD may have a positive polarity. The second voltage ELVSS may be the output voltage of the inverter 122. The second voltage ELVSS may be the voltage supplied to the cathode of the OLED. The second voltage ELVSS may have a negative polarity. The level of the second voltage ELVSS may be adjusted in accordance with temperature, as described above in connection with operations S100 to S400.

As described above, example embodiments may allow power consumption of a display to be reduced by providing a driving voltage adjusted in accordance with a sensed temperature of the display panel and/or the surroundings thereof. The driving voltage may be controlled by changing the resistance of a variable resistance element. Controlling the driving voltage may include determining the temperature and calculating the driving voltage based on the temperature. Power consumption may be reduced by regulating a DC/DC converter to reduce the driving voltage at room temperature. Additionally, reducing the driving voltage may improve the efficiency of the DC/DC converter, since high current flow through the DC/DC converter may be inefficient. Thus, embodiments may provide for increased efficiency by controlling the driving voltage output by the DC/DC converter.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

an organic light emitting display panel;

a temperature detecting unit for detecting a temperature of the organic light emitting display panel, the temperature detecting unit outputting digital temperature data corresponding to the detected temperature;

a driving voltage determining unit for outputting voltage data by calculating the driving voltage of the organic light emitting display panel on the basis of the digital temperature data output by the temperature detecting unit, wherein the driving voltage determining unit includes:

a driving voltage control unit for calculating the driving voltage in accordance with the digital temperature data, the driving voltage control unit including a look-up table in which voltage data calculated in accordance with the digital temperature data is stored, and a driving voltage output unit for outputting voltage data calculated by the driving voltage control unit; and a DC/DC converter having a variable resistor determining unit for setting a variable resistor on the basis of the voltage data output from the driving voltage determining unit, the DC/DC converter supplying the driving voltage corresponding to the variable resistor to the organic light emitting display panel, and wherein the DC/DC converter further includes:

a boost converter to supply a first voltage to the organic light emitting display panel, an inverter to supply a second voltage to the organic light emitting display panel, a switching control unit electrically connected to the boost converter and the inverter, first and second resistors serially connected to an output terminal of the boost converter, and a node, to which the first and second resistors are each connected, electrically connected with the switching control unit.

2. The organic light emitting display as claimed in claim 1, wherein:

the temperature detecting unit includes:

a temperature sensor for detecting the temperature of the organic light emitting display panel, and an A/D converter for converting an output of the temperature sensor into the digital temperature data, the setting for the variable resistor is changed in accordance with changes in the digital temperature data output from the temperature detecting unit of the organic light emitting display panel, and the driving voltage supplied to the organic light emitting display panel includes a first voltage and a second voltage, the second voltage being controlled by the variable resistor and a fixed resistor configured as a variable voltage divider.

3. The organic light emitting display as claimed in claim 1, wherein the variable resistor determining unit includes a variable resistor circuit unit having a plurality of resistors and a plurality of resistor control switching transistors which are electrically connected to the resistors, respectively.

4. The organic light emitting display as claimed in claim 3, wherein the variable resistor determining unit includes a variable resistor control unit for selecting the resistors by controlling the resistor control switching transistors.

5. The organic light emitting display as claimed in claim 4, wherein the variable resistor control unit includes a look-up table in which variable resistor data corresponding to the voltage data is stored.

6. The organic light emitting display as claimed in claim 1, wherein the switching control unit includes a first comparator electrically connected to the node where the first and second resistors are connected.

7. The organic light emitting display as claimed in claim 1, wherein the DC/DC converter includes a third resistor having one terminal electrically connected to the variable resistor circuit unit and having another terminal electrically connected to an output terminal of the inverter.

8. The organic light emitting display as claimed in claim 7, wherein each resistor control switching transistor includes:

a first electrode electrically connected to a respective resistor of the variable resistor circuit unit, and a second electrode electrically connected to the third resistor.

9. The organic light emitting display as claimed in claim 7, wherein the switching control unit includes a second comparator electrically connected to a node to which the resistors of the variable resistor circuit unit and the third resistor are connected.

10. The organic light emitting display as claimed in claim 9, wherein a voltage level of the second voltage is determined by the resistors of the variable resistor circuit unit.

11. The organic light emitting display as claimed in claim 10, wherein a voltage level of the second voltage is lower than that of the first voltage.

12. A driving method of an organic light emitting display, comprising:

detecting a temperature of an organic light emitting display panel and outputting digital temperature data corresponding to the detected temperature;

determining a driving voltage according to the digital temperature data generated from detecting the temperature, wherein the determining of the driving voltage includes generating voltage data according to the digital temperature data using a look-up table in which predetermined voltage data calculated in accordance with temperature data is stored and outputting the driving voltage based on the generated voltage data;

setting a variable resistor included in a DC/DC converter according to the generated voltage data generated from determining the driving voltage; and supplying the driving voltage corresponding to the variable resistor setting to the organic light emitting display panel, wherein supplying the driving voltage includes:

supplying a first voltage to the organic light emitting display panel through a boost converter in the DC/DC converter, and supplying a second voltage to the organic light emitting display panel through an inverter in the DC/DC converter, the DC/DC converter including a fixed resistor having one terminal electrically connected to an output terminal of the inverter and having another terminal electrically connected to the plurality of resistors, the voltage level of the second voltage determined by the plurality of resistors and the fixed resistor.

13. The driving method of the organic light emitting display as claimed in claim 12, wherein:

detecting the temperature includes an A/D conversion for converting an output of a temperature sensor into the digital temperature data after detecting the temperature of the organic light emitting display panel using the temperature sensor, and setting the variable resistor includes changing a setting for the variable resistor in accordance with changes in the digital temperature data output from detecting the temperature of the organic light emitting display panel, and supplying the driving voltage includes supplying a first voltage and a second voltage, the second voltage being controlled by the variable resistor and a fixed resistor configured as a variable voltage divider.

14. The driving method of the organic light emitting display as claimed in claim 12, wherein setting the variable resistor includes calculating a variable resistance in a variable resistor control unit included in the DC/DC converter.

15. The driving method of the organic light emitting display as claimed in claim 14, wherein calculating the variable resistance uses a look-up table in which variable resistor data corresponding to voltage data is stored.

16. The driving method of the organic light emitting display as claimed in claim 15, wherein setting the variable resistor includes selecting resistors from among a plurality of resistors that are electrically connected to respective resistor control switching transistors by selectively turning on the resistor control switching transistors using the variable resistor control unit according to the variable resistor data.

17. The driving method of the organic light emitting display as claimed in claim 12, wherein the voltage level of the second voltage is lower than that of the first voltage.

* * * * *